US008474915B2

(12) United States Patent
Toso et al.

(10) Patent No.: US 8,474,915 B2
(45) Date of Patent: Jul. 2, 2013

(54) ADJUSTABLE ERGONOMIC CHAIR

(75) Inventors: Victor Toso, St. Paul, MN (US); Benjamin G. Pratt, St. Paul, MN (US); David J. Prince, Eau Claire, WI (US)

(73) Assignee: Nada Concepts, Inc., St. Paul, MN (US)

( * ) Notice: Subject to any disclaimer, the term of this patent is extended or adjusted under 35 U.S.C. 154(b) by 0 days.

(21) Appl. No.: 13/241,616

(22) Filed: Sep. 23, 2011

(65) Prior Publication Data

US 2012/0013151 A1 Jan. 19, 2012

Related U.S. Application Data

(63) Continuation of application No. 12/415,808, filed on Mar. 31, 2009, now Pat. No. 8,052,217.

(60) Provisional application No. 61/040,952, filed on Mar. 31, 2008, provisional application No. 61/165,307, filed on Mar. 31, 2009.

(51) Int. Cl.
*A47C 7/50* (2006.01)

(52) U.S. Cl.
USPC ..... 297/423.12; 297/423.11

(58) Field of Classification Search
USPC ..... 297/423.1, 423.11, 423.12, 383
See application file for complete search history.

(56) References Cited

U.S. PATENT DOCUMENTS

| | | | | |
|---|---|---|---|---|
| 485,277 | A | | 11/1892 | Hunter |
| 1,065,022 | A | | 6/1913 | Bell |
| 2,722,974 | A | | 11/1955 | Stagner |
| 3,215,469 | A | | 11/1965 | Wamsley |
| 4,065,180 | A | | 12/1977 | Karay |
| 4,247,064 | A | | 1/1981 | Schulman et al. |
| 4,510,633 | A | * | 4/1985 | Thorne ..... 5/87.1 |
| 4,650,249 | A | | 3/1987 | Serber |
| 4,762,364 | A | | 8/1988 | Young |
| 4,763,952 | A | | 8/1988 | Gaudrau, Jr. |
| 4,793,655 | A | * | 12/1988 | Kvalheim et al. ..... 297/423.13 |
| 4,832,407 | A | * | 5/1989 | Serber ..... 297/423.12 |
| 4,948,156 | A | | 8/1990 | Fortner |
| 5,054,852 | A | * | 10/1991 | Tholkes ..... 297/172 |
| 5,251,961 | A | | 10/1993 | Pass |
| 5,342,116 | A | * | 8/1994 | Walton ..... 297/466 |

(Continued)

FOREIGN PATENT DOCUMENTS

| | | | |
|---|---|---|---|
| BR | 6400758 | U | 12/1985 |
| CA | 454926 | A | 3/1949 |

(Continued)

*Primary Examiner* — David Dunn
*Assistant Examiner* — Erika Garrett
(74) *Attorney, Agent, or Firm* — Seager, Tufte & Wickhem LLC

(57) ABSTRACT

An ergonomic task chair having a front and a rear, including a laterally extending seat having a front and a rear, a back brace disposed above the rear of the seat, and a knee support disposed in the front of the chair, wherein the back brace and the knee support have a first position where there is a first minimum distance between the back brace and the knee support and a second position where there is a second minimum distance between the back brace and the knee support, the second minimum distance being less than the first minimum distance, wherein movement from the first minimum distance to the second minimum distance is triggered by a downward movement of the seat.

13 Claims, 8 Drawing Sheets

U.S. PATENT DOCUMENTS

| | | | | |
|---|---|---|---|---|
| 6,086,157 | A * | 7/2000 | Toso | 297/423.11 |
| 6,123,392 | A * | 9/2000 | Alfred et al. | 297/466 |
| 6,440,056 | B1 * | 8/2002 | Singh et al. | 554/165 |
| 6,729,690 | B2 * | 5/2004 | Martin et al. | 297/423.12 |
| 7,070,241 | B2 | 7/2006 | Saulnier et al. | |
| 7,222,920 | B1 * | 5/2007 | Washington | 297/383 |
| 7,234,768 | B2 * | 6/2007 | Manning | 297/94 |
| 7,367,623 | B2 | 5/2008 | Tholkes et al. | |
| 7,578,797 | B2 * | 8/2009 | Hazard | 601/103 |
| 2007/0063569 | A1 * | 3/2007 | Mays | 297/423.12 |
| 2008/0272628 | A1 | 11/2008 | Lazar | |
| 2009/0140567 | A1 | 6/2009 | Weiss | |

FOREIGN PATENT DOCUMENTS

| | | | |
|---|---|---|---|
| DE | 3903388 | A1 | 8/1990 |
| FR | 1288753 | A | 3/1962 |
| WO | 8602243 | A1 | 4/1986 |
| WO | 2005041721 | A2 | 5/2005 |
| WO | 2006041232 | A1 | 4/2006 |
| WO | 2008026209 | A3 | 3/2008 |
| WO | 2008085174 | A1 | 7/2008 |

* cited by examiner

ADJUSTABLE ERGONOMIC CHAIR

RELATED APPLICATIONS

This application is a continuation of U.S. application Ser. No. 12/415,808 filed Mar. 31, 2009 which claims priority to U.S. provisional application No. 61/040,952, entitled "Adjustable Ergonomic Chair" and filed Mar. 31, 2008, and hereby incorporates the same by reference, and to U.S. provisional application No. 61/165,307, entitled "Adjustable Task Chair" and filed on Mar. 31, 2009, and hereby incorporates the same by reference.

FIELD

The invention relates to chairs or supports, and more specifically to chairs in which the user's back and knees are supported with respect to the chair seat to enhance the anatomical, physiological and psychological support afforded to the user by the chair.

BACKGROUND

Many people spend the substantial part of their workday sitting in a task chair at a desk or table. Therefore, properly designed task chairs and posture are important for the comfort and health of many people. To this end, many different task chairs have been devised.

Many designs are directed towards adjustability, weight distribution and style but few designs ensure that the user is sitting properly in the chair. One such design is the so-called kneeling chair, where the seat is at a forward angle such that the knees are lower than the hips and the thighs are at an angle of about 60 to 70 degrees from vertical, and some weight is borne by the knees. Another such design is described in U.S. Pat. No. 6,086,157 to Toso, entitled "Ergonomic Chair" and hereby incorporated by reference. This design incorporates a horizontal seat, a back brace and a knee brace, which are adjustable with respect to each other. This design ensures proper posture because the knee brace prevents slouching or other incorrect posture. Another solution to this problem may be found in U.S. Pat. No. 4,773,106 to Toso et al., entitled "Back Support" and hereby incorporated by reference, which is directed to a back support strap that permits the wearer to sit in an upright position for extended periods of time by tensioning the strap against the knees to support the wearer's back.

There is thus an ongoing need to develop ergonomic task chairs that provide comfort and proper positioning.

SUMMARY

One embodiment pertains to an ergonomic task chair which maintains a seated person in an erect position in order to aid in relieving stress in the back while seated. The ergonomic task chair includes a seat portion, a back brace portion and a knee brace portion. The ergonomic task chair also includes struts to connect the knee brace and the back brace to the seat such that the knee brace and the back brace automatically adjust from a first position to a second position when a person sits in the task chair. The first position is a position where the back brace and the knee brace are spread out from each other to permit easy access to the chair and the second position is a position when the back brace and knee brace are closer together. In the second position, the back brace applies pressure to the lower back of the seated person and the knee brace applies pressure to the knees or upper shins of the seated person to help maintain an optimal seated posture for the seated person.

The chair may include a back in which the back brace is disposed. In some embodiments, the back includes an upper back portion and a lower back portion and the back brace is disposed between the upper back portion and the lower back portion. Some embodiments may include arm rests, which may be adjustable. In some embodiments the chair is disposed on a wheeled or footed base. The base may have five feet or wheels and may include a hydraulic arm or other system to adjust the height of the seat to customize the chair to an individual. The back brace may be attached by a telescoping mechanism to allow the user to adjust the height of the back brace relative to the seat. Likewise the knee brace may be attached by a telescoping mechanism to allow the user to adjust the forward distance of the knee brace with respect to the seat. A button, lever or other mechanism may be included to lock the chair in the first position.

The knee brace may include a left knee brace and a right knee brace, which may pivot to the sides of the chair to allow easier access to the seat and to allow the chair to be used as a regular task chair when desired.

In some embodiments, the seat is suspended above and spaced apart from the base, which base is connected to a top platform. One or more struts from the back brace are pivotably connected to the front of the platform and slideably and pivotably connected to the bottom of the front of the seat. In a similar fashion, one or more struts from the knee braces are pivotably connected to the rear of the platform and slideably and pivotably connected to the rear of the bottom of the seat. This connection arrangement fixes the seat above and spaced apart from the platform and allows the back brace and knee braces to close into position when a user sits in the chair. The back brace may be pivotably connected to the back brace struts and the knee braces may likewise be pivotably connected to the knee brace struts.

One embodiment pertains to an ergonomic task chair having a front and a rear that includes a laterally extending seat having a front and a rear, a back brace disposed above the rear of the seat, and a knee support disposed in the front of the chair, wherein the back brace and the knee support have a first position where there is a first minimum distance between the back brace and the knee support and a second position where there is a second minimum distance between the back brace and the knee support, the second minimum distance being less than the first minimum distance, wherein movement from the first minimum distance to the second minimum distance is triggered by a downward movement of the seat.

Some embodiment pertains to a task chair as described above and further including a platform disposed beneath and spaced apart from the seat, the platform having a front and a rear, a back brace strut, a knee brace strut, wherein the back brace strut is connected to the back brace, the platform and the seat, and wherein the knee brace strut is connected to the knee brace, the platform and the seat. Some embodiments pertain to a task chair as described above and wherein the back brace strut is connected to the front of the platform and the front of the seat and wherein the knee brace is connected to the rear of the platform and the rear of the seat. Some embodiments pertain to a task chair as described above and wherein the back brace strut is connected to the platform by a first joint that allows the back brace strut to pivot about a first axis with respect to the platform and wherein the knee brace strut is connected to the platform by a second joint that allows the knee brace strut to pivot with respect to the platform about a second axis.

Some embodiments pertain to a task chair as described above and wherein the back brace strut is connect to the seat by a first joint that allows the back brace strut to pivot with respect to the seat about a first axis and to slide with respect to the seat along a second axis and wherein the knee brace strut is connect to the seat by a second joint that allows the back brace strut to pivot with respect to the seat about a third axis and to slide with respect to the seat along a fourth axis.

Some embodiments pertain to a task chair as described above and wherein the back brace is biased to the first position.

Some embodiments pertain to a task chair as described above and wherein the back brace is biased to the first position by a hydraulic cylinder.

Some embodiments pertain to a task chair as described above and wherein the back brace is biased to the first position by a spring.

Some embodiments pertain to a task chair as described above and wherein the knee brace is biased to the first position.

Some embodiments pertain to a task chair as described above and wherein the back brace is pivotably connected to the back brace strut.

Some embodiments pertain to a task chair as described above and wherein the knee brace is pivotably connected to the knee brace strut.

Some embodiments pertain to a task chair as described above further including a back disposed above the rear of the seat portion wherein the position of the back relative to the seat portion does not change between the first position and the second position.

Some embodiments pertain to a task chair as described above and wherein the back comprises an upper back portion and a lower back portion and wherein the back brace is disposed between the upper back portion and the lower back portion where in the first position.

Some embodiments pertain to a task chair as described above and further including a second back brace strut connected to the back brace, the platform and the seat.

Some embodiments pertain to a task chair as described above and wherein the knee brace is a left knee brace and further comprising a right knee brace and a second knee brace strut, the knee brace strut connected to the left knee brace and the second knee brace strut connected to the right knee brace.

Some embodiments pertain to a task chair as described above and wherein the knee brace strut includes a hinge such that the left knee brace can be moved from a position in front of the seat to a position that is to the left of the first position and wherein the second knee brace strut includes a hinge such that the right knee brace can be moved from a position in front of the seat to a position that is to the right of the first position.

The above summary of some example embodiments is not intended to describe each disclosed embodiment or every implementation of the invention.

BRIEF DESCRIPTION OF THE DRAWINGS

The invention may be more completely understood in consideration of the following detailed description of various embodiments in connection with the accompanying drawings, in which.

Figure 1:
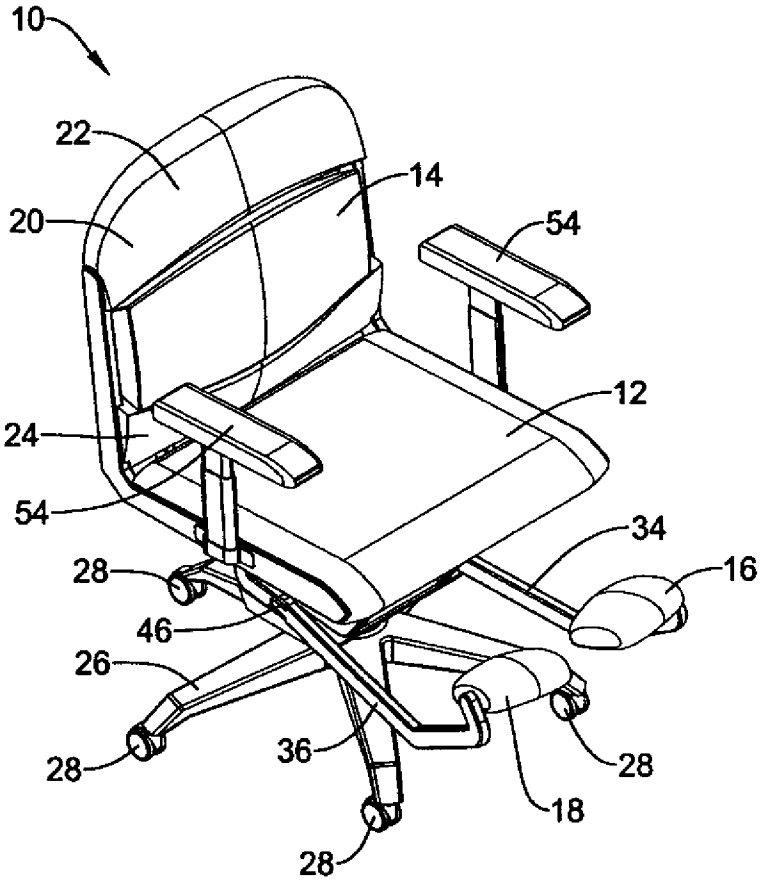
FIG. 1 is a diagrammatic isometric view of an adjustable task chair 10 in accordance with one embodiment of the invention in a first position.

While the invention is amenable to various modifications and alternative forms, specifics thereof have been shown by way of example in the drawings and will be described in detail. It should be understood, however, that the intention is not to limit aspects of the invention to the particular embodiments described. On the contrary, the intention is to cover all modifications, equivalents, and alternatives falling within the spirit and scope of the invention.

DETAILED DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may be indicative as including numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

Although some suitable dimensions ranges and/or values pertaining to various components, features and/or specifications are disclosed, one of skill in the art, incited by the present disclosure, would understand desired dimensions, ranges and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following detailed description should be read with reference to the drawings in which similar elements in different drawings are numbered the same. The detailed description and the drawings, which are not necessarily to scale, depict illustrative embodiments and are not intended to limit the scope of the invention. The illustrative embodiments depicted are intended only as exemplary. Selected features of any illustrative embodiment may be incorporated into an additional embodiment unless clearly stated to the contrary.

Referring now to FIGS. 1-8, an adjustable task chair 10 is shown from various perspectives as described above. FIGS. 1, 3, 5, 7 and 8 illustrate the chair in a first position, which is the position that the chair 10 will generally assume when empty.

Figure 2:
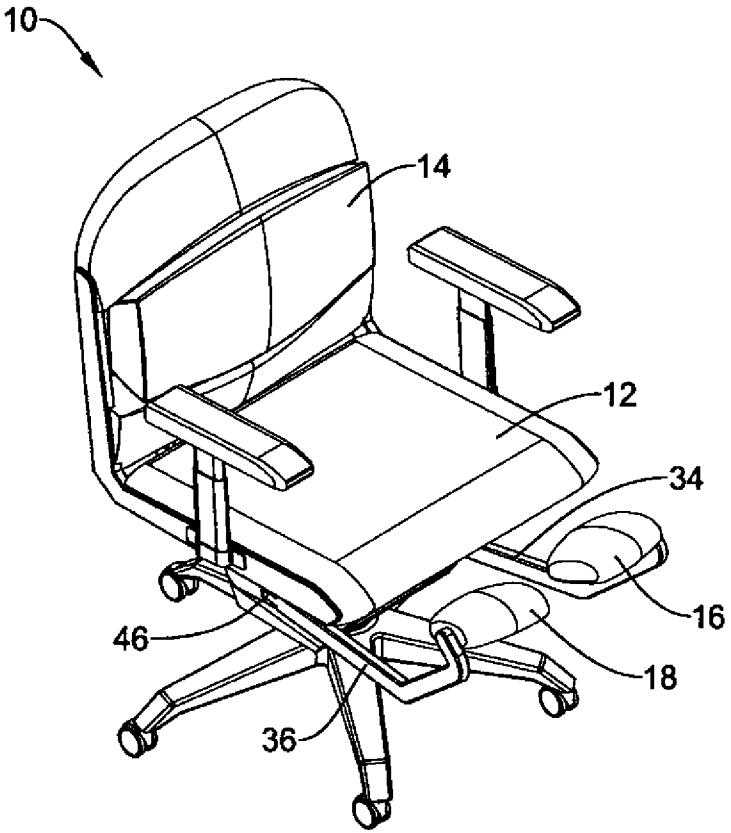
FIG. 2 is a diagrammatic isometric view of an adjustable task chair 10 in accordance with one embodiment of the invention in a second position.
Figure 4:
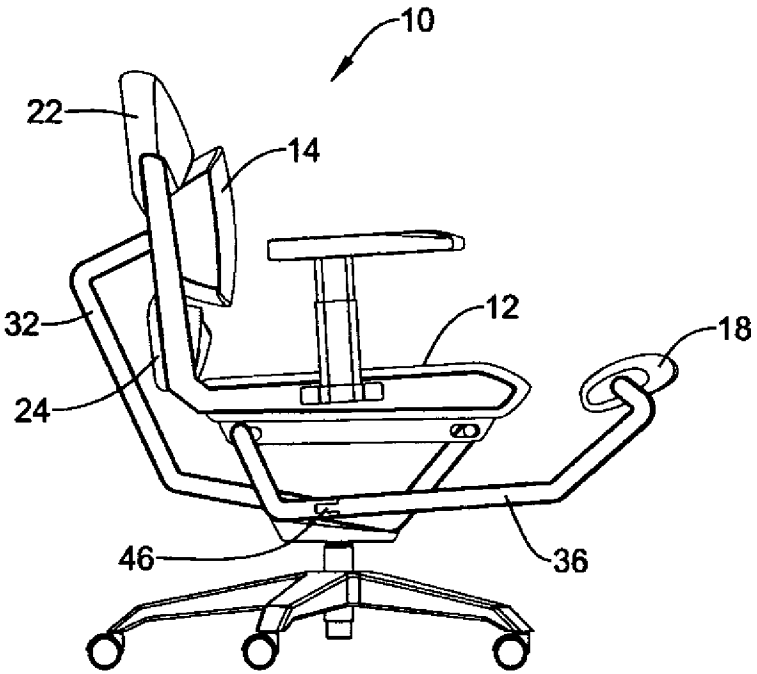
FIG. 4 is a diagrammatic right side view of an adjustable task chair 10 in accordance with one embodiment of the invention in a second position.
Figure 5:
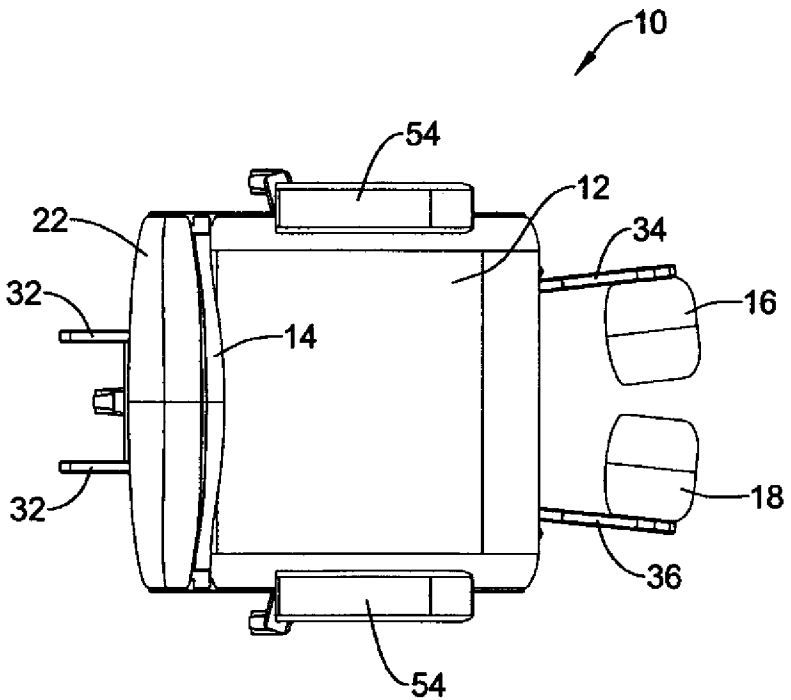
FIG. 5 is a diagrammatic front view of an adjustable task chair 10 in accordance with one embodiment of the invention in a first position.
Figure 6:
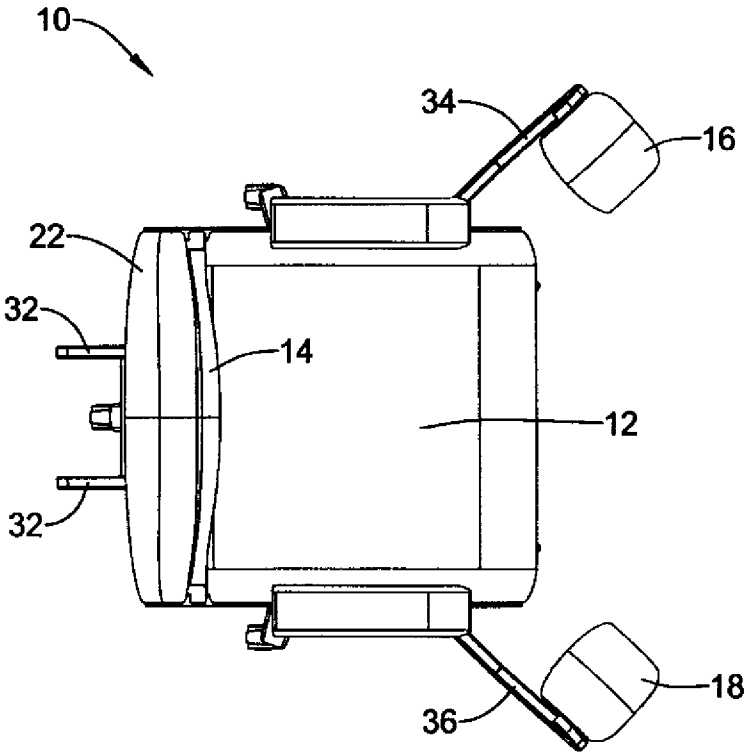
FIG. 6 is a diagrammatic front view of an adjustable task chair 10 in accordance with one embodiment of the invention in a second position.

FIGS. 2, 4 and 6 illustrate the chair in a second position, which is a position the chair may assume when someone is sitting in the chair (the user is not illustrated). The reference directions used herein will be from the perspective of one sitting in the chair as it is intended to be sat in. It is from this perspective that terms such as front, rear, left, right, raise, lower, up, down and the like should be understood.

The chair 10 includes a seat 12 that extends generally laterally, a back brace 14 and one or more knee braces 16 and 18. While embodiments are contemplated where a single knee brace extends across the front to accommodate a pair of knees, the embodiment illustrated includes a left knee brace 16 and a right knee brace 18. The back brace may be integrated into a back 20. The back 20 does not move with the back brace from the first position to the second position and thus, during seating, is fixed with respect to seat 10. Back 20, nevertheless, may be other adjustable with respect to seat 12 to accommodate particular users and particular adjustments to the back brace 14. Back 20 may include an upper back portion 22 and an lower back portion 24 where the back brace 14 is disposed between the upper and lower back portions as illustrated. In some embodiments, a button or lever is included that can be operated to lock the chair into the first position or, in other embodiments, into any desired position so that the chair may be used as a typical task chair.

Back brace 14 is attached to the rest of chair 10 through one or more back brace struts 32. In the embodiment illustrated, two back brace struts 32 are illustrated which are disposed symmetrically about a plane between the left and right halves of the chair. It can be appreciated, however, that other configurations for attaching the back brace to the rest of chair 10 using one or more back brace struts are possible. For example, a single back brace strut 32 may be disposed along the plane described above. Back brace 14 may be pivotably connected to back brace struts 32 and may be biased by springs or another mechanism (not shown) to a default position. Back brace struts 32 may also include a telescoping portion (not shown) to allow a user to raise or lower the back brace 14 to a desired height.

Figure 7:
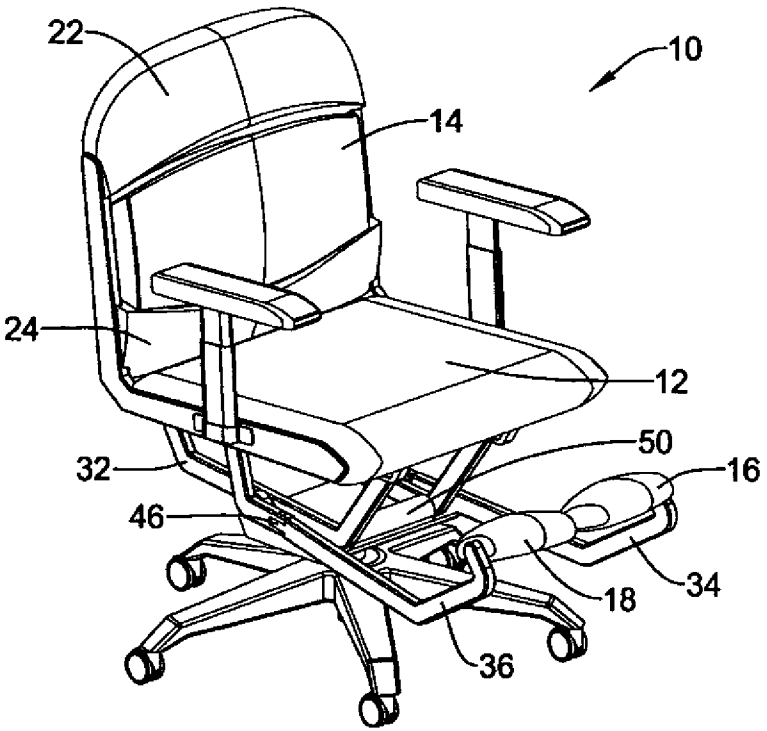
FIG. 7 is a diagrammatic isometric view of an adjustable task chair 10 in accordance with one embodiment of the invention in a first position.
Figure 8:
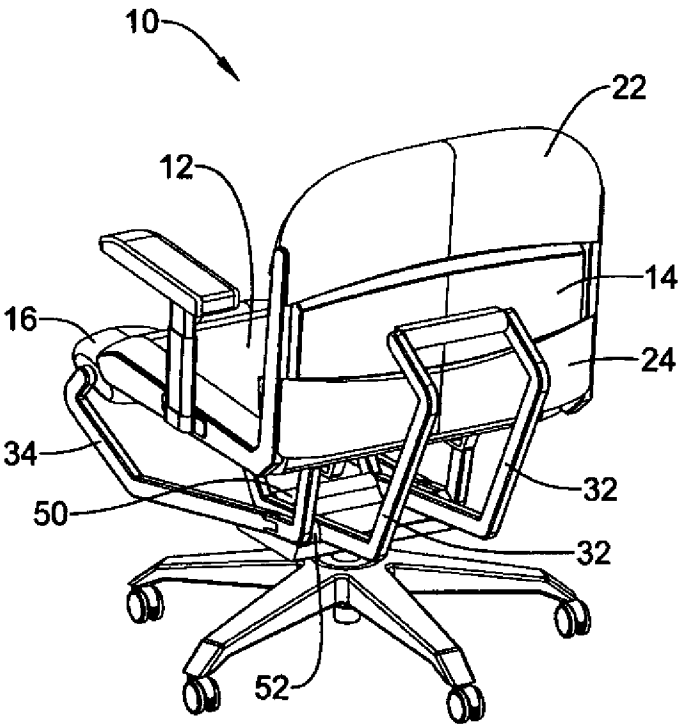
FIG. 8 is a diagrammatic isometric view of an adjustable task chair 10 in accordance with one embodiment of the invention in a first position.

Left and right knee braces 16 and 18 are connected to the rest of the chair 10 using left and right knee brace struts 34 and 36, respectively. Each strut may include a hinge to allow the left and right knee braces to swing out to provide easier access to the seat as illustrated in FIGS. 7 and 8. Hinge 46 in right knee brace strut 36 may be seen in several of the views. Hinge 46 may include one or more detents to fix the struts in certain desired positions. For example, one detent may fix the struts in the position shown in FIG. 7 and, in other embodiments, another detent may fix the struts in the position shown in FIG. 8. An appropriate degree of lateral force may allow a user to over the force of the detent to move the struts between positions. Left and right knee braces may also include telescoping portions (not shown) to allow a user to lengthen or shorten the struts to accommodate a particular user.

A chair base 26 may include wheels 28 and may be of any suitable configuration. For example, the chair base 26 illustrated includes five wheels 28 on arms extending radially out from a central hub. On top of chair base 26 is a platform 30, which may be seen in FIGS. 3, 4, 7 and 8. Platform 30 may be connected to chair base 26 with a hydraulic cylinder 48 or other suitable mechanism for adjusting the height of the seat 12 and other portions of the chair above the cylinder by the use of a lever (not shown).

Struts 32, 34 and 36 may be connected to the chair and the platform in the following manner. As can be seen, for example, in FIG. 3, back brace struts 32 curve or bend around the bottom of seat 12 and are attached to seat 12 near the front of the seat. The connections between back brace struts 32 and seat 12 allow for lateral movement in a front to back direction and pivoting about an axis extending parallel to the front of the seat 12. When the chair is in the first position, the back brace struts are towards the rear of their lateral freedom of movement in the connection. As can be better send in FIG. 7, the back brace struts 32 are attached to the platform 30 in the front portion of platform 30. Element 50 is a hinge that allows pivoting of the back brace struts with respect to platform 30. Element 50 may be a simple hinge or may be a hinge biased to keep back brace 14 in the first position. Element 50 may be biased by the inclusion of a spring or hydraulic element as desired. In some embodiments, an additional biasing element is not needed to move the chair into the first position. The back brace 14 and the back brace struts 32 are substantially to the rear of the pivot connection with the platform 30. Likewise, the knee braces and the knee brace struts are substantially to the front of their pivot connections with platform 30. The weight of the configuration, therefore, may be sufficient to move the chair to the first position when empty.

Figure 3:
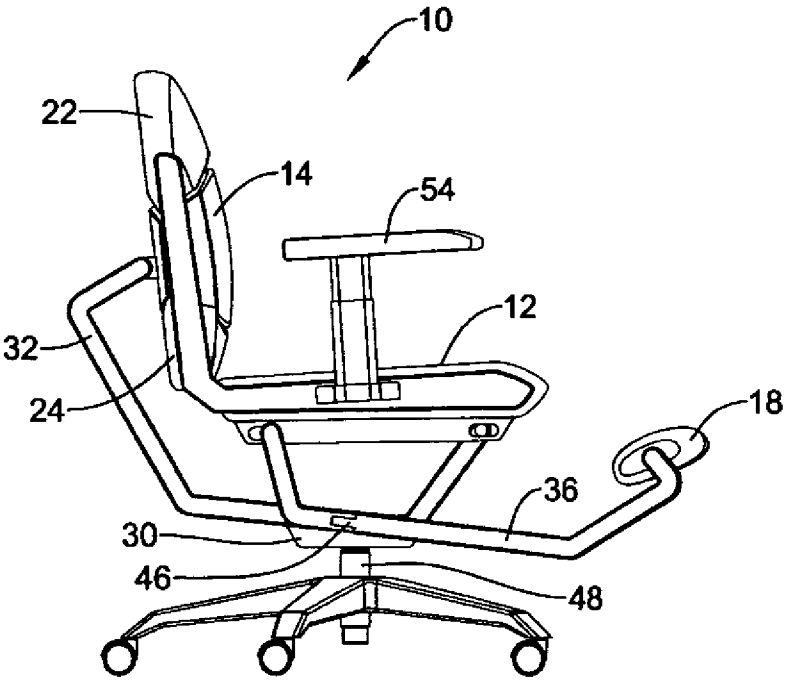
FIG. 3 is a diagrammatic right side view of an adjustable task chair 10 in accordance with one embodiment of the invention in a first position.

Knee brace struts 34 and 36 similarly curve or bend around the bottom of seat 12 to connect to the rear of seat 12 as shown in FIG. 3. The connections between struts 34 and 36 and seat 12 allows for lateral movement in a front to back direction and pivoting about an axis extending parallel to the rear of the seat 12. When the chair is in the first position, the knee brace struts are towards the front of their lateral freedom of movement in the connection. Knee brace struts are pivotably connected to the rear of platform 30 at joints 52 as can be best seen in FIG. 8.

The chair 10 may also include armrests 54, which may be adjustable to fit the user, and which may be attached to the seat as illustrated.

The chair may be manufactured in any desired manner as is known in the art. For example, the chair may include fabrics, meshes, foam, batting, metal and polymer parts as appropriate and desired and may be fabricated using any conventional manufacturing techniques.

In use, a user may open the knee brace struts 34 and 36 as illustrated in FIG. 8 and move so the back of the knees are near the front edge of the seat 12. The user may then close the knee brace struts 34 and 36 to the position shown in FIG. 7 and sit in the chair. The weight of the user will cause both the back brace 14 and the knee braces 16 and 18 to rotate inward towards the user. The back brace will contact the user's back and the knee braces will contact the users knees and urge the user into an erect sitting position, where pressure from the back brace and the knee braces will support the user in the erect sitting position.

Those skilled in the art will recognize that the present invention may be manifested in a variety of forms other than the specific embodiments described and contemplated herein. Accordingly, departure in form and detail may be made without departing from the scope and spirit of the present invention as described in the appended claims.

The invention claimed is:

1. An ergonomic task chair having a front and a rear, comprising:

a laterally extending seat having a front and a rear and a seat top surface therebetween;

a back brace disposed above the rear of the seat and configured to move in a direction generally parallel to the seat top surface;

a knee support disposed in the front of the chair, wherein the back brace and the knee support have a first position where there is a first minimum distance between the back brace and the knee support and a second position where there is a second minimum distance between the back brace and the knee support, the second minimum distance being less than the first minimum distance, wherein movement from the first minimum distance to the second minimum distance results from moving the back brace generally parallel to the seat top surface and toward the knee support;

a platform disposed beneath and spaced apart from the seat, the platform having a front and a rear;

a back brace strut; and a knee brace strut;

wherein the back brace strut is connected to the back brace, the platform and the seat, wherein the knee brace strut is connected to the knee brace, the platform and the seat; and further wherein the back brace strut is connected to the front of the platform and the front of the seat and wherein the knee brace is connected to the rear of the platform and the rear of the seat.

2. The ergonomic task chair of claim 1, further comprising a back disposed above the rear seat portion wherein the position of the back relative to the seat portion does not change between the first position and the second position.

3. The ergonomic task chair of claim 2, wherein the back comprises an upper back portion and a lower back portion and wherein the back brace is disposed between the upper back portion and the lower back portion where in the first position.

4. The ergonomic task chair of claim 1, wherein movement from the first minimum distance to the second minimum distance is triggered by a downward movement of the seat.

5. The ergonomic task chair of claim 1, wherein the back brace strut is connected to the platform by a first joint that allows the back brace strut to pivot about a first axis with respect to the platform and wherein the knee brace strut is connected to the platform by a second joint that allows the knee brace strut to pivot with respect to the platform about a second axis.

6. The ergonomic task chair of claim 1, wherein the back brace strut is connect to the seat by a first joint that allows the back brace strut to pivot with respect to the seat about a first axis and to slide with respect to the seat along a second axis and wherein the knee brace strut is connected to the seat by a second joint that allows the back brace strut to pivot with respect to the seat about a third axis and to slide with respect to the seat along a fourth axis.

7. The ergonomic task chair of claim 1, wherein the back brace is biased to the first position.

8. The ergonomic task chair of claim 1, wherein the knee brace is biased to the first position.

9. The ergonomic task chair of claim 1, wherein the back brace is pivotably connected to the back brace strut.

10. The ergonomic task chair of claim 1, wherein the knee brace is pivotably connected to the knee brace strut.

11. The ergonomic task chair of claim 1, further comprising a second back brace strut connected to the back brace, the platform and the seat.

12. The ergonomic task chair of claim 1, wherein the knee brace is a left knee brace and further comprising a right knee brace and a second knee brace strut, the knee brace strut connected to the left knee brace and the second knee brace strut connected to the right knee brace.

13. The ergonomic task chair of claim 1, wherein the knee brace strut includes a hinge such that the left knee brace can be moved from a position in front of the seat to a position that is to the left of the first position and wherein the second knee brace strut includes a hinge such that the right knee brace can be moved from a position in front of the seat to a position that is to the right of the first position.

* * * * *